US006217312B1

(12) United States Patent
Levinson et al.

(10) Patent No.: US 6,217,312 B1
(45) Date of Patent: Apr. 17, 2001

(54) IGNITION SYSTEM FOR A GAS APPLIANCE

(75) Inventors: Lionel Monty Levinson, Niskayuna; James Rollins Maughan, Scotia, both of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/301,980

(22) Filed: Apr. 29, 1999

(51) Int. Cl.[7] ..... F23N 5/22; F23N 5/24

(52) U.S. Cl. ..... 431/6; 431/66; 431/67; 431/72; 431/28; 126/39 E; 126/19 R; 219/262; 361/264

(58) Field of Search ..... 431/6, 18, 67, 431/80, 77, 82, 72, 73, 62, 63, 66, 68, 76, 74, 28; 126/19 R, 39 E; 236/15 R, 15 A, 15 BR, 15 BG; 251/129.01, 129.02, 129.15; 361/264, 265

(56) References Cited

U.S. PATENT DOCUMENTS

| | | | | |
|---|---|---|---|---|
| 3,887,325 | * | 6/1975 | Finger et al. | 431/6 |
| 3,963,410 | | 6/1976 | Baysinger | 431/46 |
| 4,529,373 | * | 7/1985 | Ortlinghaus | 431/6 |
| 4,711,628 | | 12/1987 | Geary | 431/71 |
| 4,755,132 | * | 7/1988 | Geary | 431/6 |
| 4,865,538 | * | 9/1989 | Scheele et al. | 431/18 |
| 5,364,260 | * | 11/1994 | Moore | 431/6 |
| 5,391,074 | * | 2/1995 | Meeker | 431/6 |
| 5,514,630 | | 5/1996 | Willkens et al. . | |
| 5,607,254 | * | 3/1997 | Grembowicz et al. | 431/6 |
| 5,722,823 | | 3/1998 | Hodgkiss | 431/80 |
| 5,791,890 | | 8/1998 | Maughan | 431/6 |
| 5,820,789 | | 10/1998 | Willkens et al. . | |

FOREIGN PATENT DOCUMENTS

| | | | | |
|---|---|---|---|---|
| 58 052 913 | * | 3/1983 | (JP) | 431/76 |

OTHER PUBLICATIONS

Ceramic Heaters, Kyocera Corp. Catalog No. CAT/IT9606TYA3580E (1995).

* cited by examiner

*Primary Examiner*—Ira S. Lazarus
*Assistant Examiner*—Josezah C. Cocks
(74) *Attorney, Agent, or Firm*—Toan B. Vo; Noreen C. Johnson

(57) ABSTRACT

An ignition system for a gas appliance comprises an ignition controller that receives a current from a power source. The ignition controller is also coupled to an ignitor and to a current actuated valve that releases a flow of gas when the current is greater than a first predetermined current value and less than a second predetermined current value. Ignition safety for the gas appliance is provided by establishing a fixed range of current through the ignitor before the gas valve is opened.

25 Claims, 8 Drawing Sheets

IGNITION SYSTEM FOR A GAS APPLIANCE

FIELD OF THE INVENTION

The present invention is related to gas ignition systems. In particular, the present invention is related to gas ignition systems for gas appliances and heating equipment, including gas ranges.

BACKGROUND

Conventional gas appliances and heating equipment, such as gas ranges, often use silicon carbide (SiC) hot surface ignitors or spark ignitors. The conventional SiC ignitor is designed to survive in the gas range environment. The SiC ignitor is normally placed in series with the gas valve. The gas valve is designed to open when the current supplied to it exceeds a certain value. The SiC ignitor has a carefully controlled resistance versus temperature characteristic such that: (1) when current is initially supplied to the ignitor and the ignitor is cold, it has a relatively high resistance that keeps the current low enough so the gas valve stays closed; and (2) when the ignitor heats up, the resistance drops so the current becomes sufficiently large to open the gas valve. When the current reaches this threshold point, the ignitor is hot enough to ignite the gas. This resistance versus temperature relationship serves as a "fail-safe" in that the ignitor must reach a certain temperature before the gas valve opens, thus avoiding the situation of gas flowing to an ignitor which is not hot enough to ignite the gas.

Conventional SiC gas range ignitors are produced by several commercial vendors, including Surface Igniter Co. of Chagrin Falls, Ohio and Saint-Gobain/Norton Co. of Milford, N.H. Some of the problems with these conventional ignitors are that they are porous, fragile, and expensive. In addition, the resistance versus temperature characteristics of these conventional SiC ignitors may alter or drift over time, thereby adversely affecting their reliability.

Ignitor materials which are more mechanically robust than SiC have also been developed. One such ignitor, the Mini-Ignitor®, available from the Saint-Gobain/Norton Company of Milford, N.H., comprises a pressure sintered composite of aluminum nitride ("AlN"), molybdenum disilicide ("$MoSi_2$"), and silicon carbide ("SiC"), and is designed for 8 volt through 48 volt applications. However, the resistance versus temperature characteristics of the pressure sintered composite material is different from the resistance characteristics of conventional ignitor materials such as SiC. Generally, the pressure sintered composite material has a resistance which increases with temperature (e.g., a metallic resistance characteristic). Accordingly, pressure sintered composite ignitors are generally not compatible with existing conventional ignition systems which rely on a resistance fail safe region.

Thus, there is a need for a reliable ignition system which does not rely on a resistance fail safe region and which is not susceptible to performance degradation due to temperature drifts.

SUMMARY

The present invention provides an ignition system for gas appliances comprising an ignition controller coupled to a power source to receive a current from the power source. The ignition controller is coupled to an ignitor. The ignition controller is also coupled to a current actuated valve that releases a flow of gas when the current is greater than a first predetermined current value and less than a second predetermined current value.

The present invention further provides a gas oven comprising ignition control means. An ignitor is coupled to the ignition control means. The ignition control means is also coupled to a current actuated valve that releases a flow of gas when the current is greater than a first predetermined current value and less than a second predetermined current value. A burner is also coupled to the gas valve to receive the flow of gas.

The present invention provides a method for controlling the ignition of a burner with an ignitor. A current (I) is provided to the ignitor. A valve that releases a flow of gas is opened when the current (I) is greater than a first current value ($I_1$) and less than a second current value ($I_2$), where $I_1$ is less than $I_2$. Thus, the ignitor ignites gas flowing from the burner when $I_1<I<I_2$.

DETAILED DESCRIPTION OF THE PREFERRED EMBODIMENTS

Figure 1:
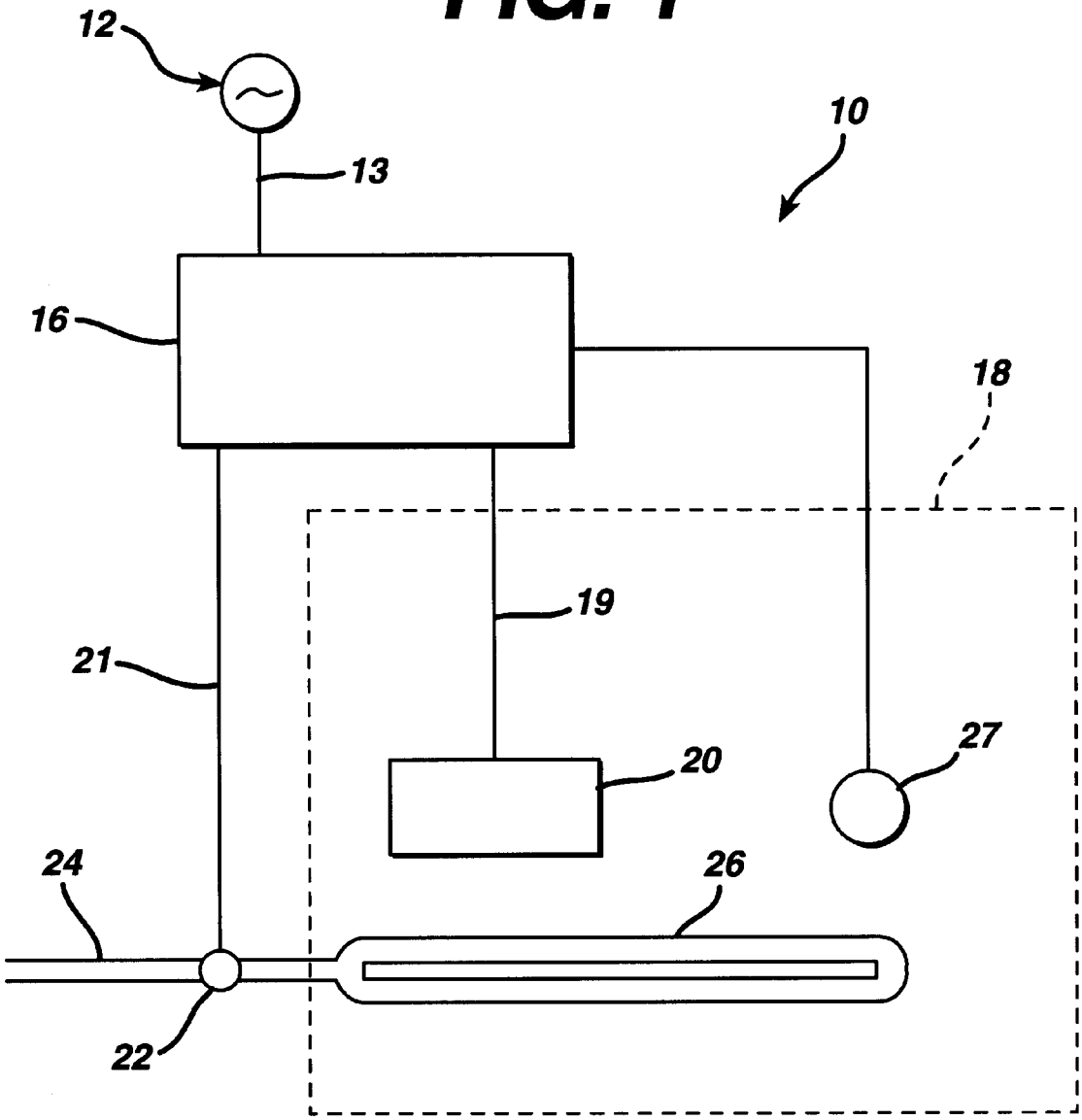
FIG. 1 shows one embodiment of an ignition system incorporated in a gas oven according to an exemplary embodiment of the present invention.

The present invention relates to an ignition system for gas appliances and heating equipment. An ignition system according to one embodiment of the present invention is shown in FIG. 1. The ignition system 10 includes a controller 16, an ignitor 20, a main burner 26, and a current actuated valve 22. Ignition system 10 is coupled to a power source 12 to provide current for the ignition system. For example, power source 12 can be a standard 120 volt alternating current (AC) power source. Alternatively, the power source 12 can be an 80 volt power source or a 240 volt power source. Line 13 couples power source 12 to ignition controller 16 within ignition system 10.

Ignitor 20 is coupled to ignition controller 16 via line 19. Ignitor 20 can comprise a pressure-sintered composite material or other material which has a metallic resistance characteristic, as will be discussed in more detail below. Ignition controller 16 is also coupled to current actuated valve 22 via a line 21. Main burner 26 is adapted to be supplied fuel, such as natural gas, propane, etc., from a fuel source (not shown) via a gas conduit 24. Ignitor 20 is disposed adjacent to burner 26, which can be housed inside an oven chamber 18. Alternatively, burner 26 can be located atop a conventional range. In addition, a conventional gas regulator (not shown) can be disposed in conduit 24 between the fuel source and valve 22. When valve 22 is open, fuel flows to burner 26. Generally, the ignitor remains energized whenever the gas valve 22 is open. Valve 22 can be any type of suitable valve such as a conventional solenoid valve, which can be inexpensive and has good reliability.

Optionally, an ignition indicator 27 can also be housed in oven chamber 18 and adjacent burner 26. Ignition indicator 27 can be a thermostat, a thermocouple, a resistance temperature device, a light sensor, or other flame sensitive device. Indicator 27 can be used to determine when flames are present.

Ignition controller 16 is able to control the opening and closing of valve 22 as well as the energization of ignitor 20. Ignition controller 16 can be adapted to receive a selection or control signal from a user-operated control knob (not shown), which can cause the ignition of gas at burner 26 and set a desired temperature within oven chamber 18. When the user-operated control knob is in an "off" position, current is not available to ignitor 20 from power source 12.

Figure 2:
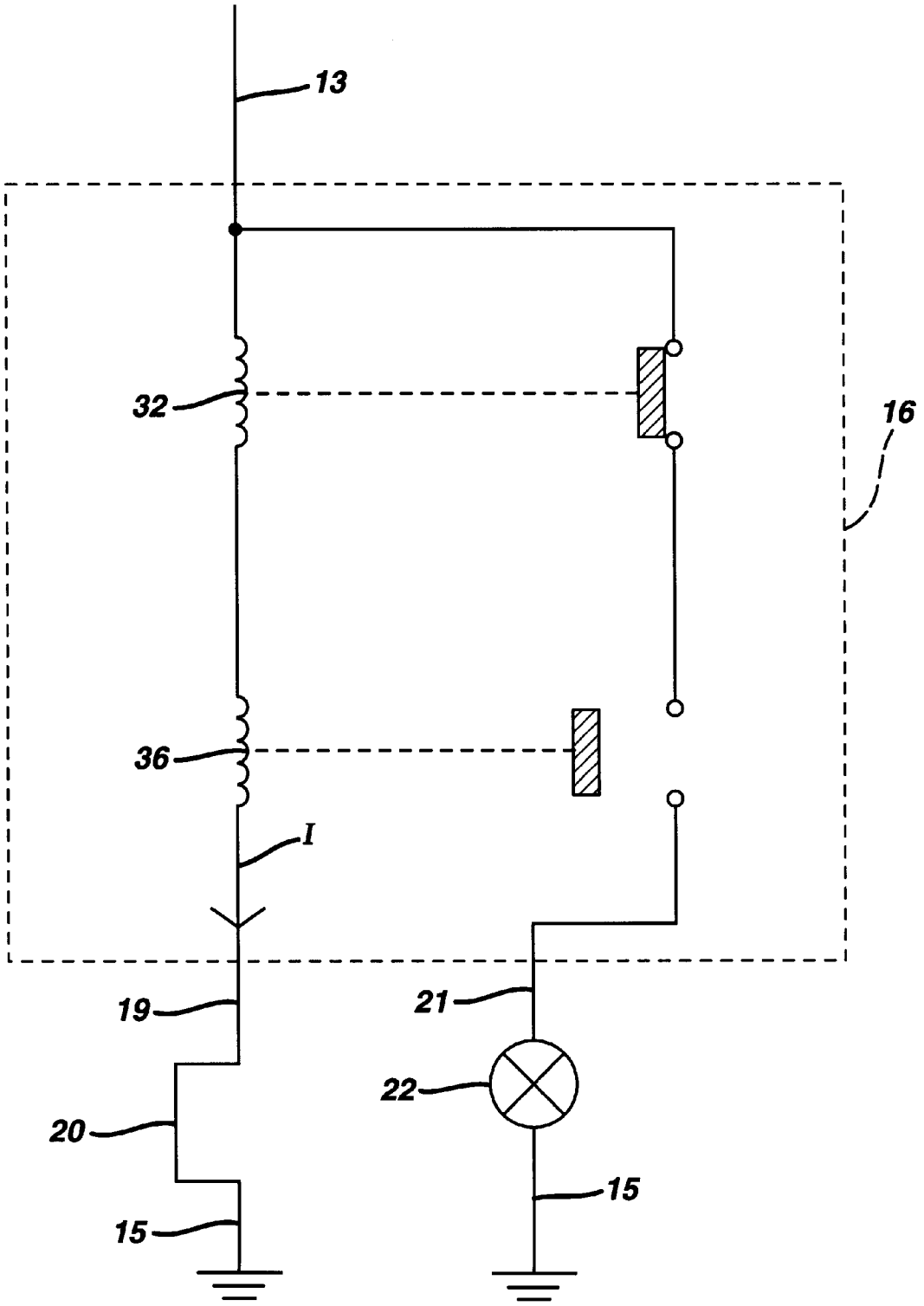
FIG. 2 shows another embodiment of the ignition system.

FIG. 2 shows one embodiment of ignition controller 16 that produces acceptable results. Ignition controller 16 is designed such that gas valve 22 is opened only when the ignition temperature is reached. A suitable ignition temperature is realized when the current (I) reaching ignitor 20 is of a predetermined level. In this embodiment, ignition controller 16 comprises relays 32 and 36 that are placed in series and couple line 13 to line 21 (power source to gas valve). Relays 32 and 36 typically comprise current actuated or driven switches.

In the embodiment shown in FIG. 2, relay 32 is normally closed. Relay 32 opens only if the current I is greater than an upper current level $I_2$. When relay 32 is open, line 13 is not connected to line 21 and gas valve 22.

Relay 36 is a current actuated relay that is normally in the open position, as shown in FIG. 2. When relay 36 is in the open position, line 13 is not connected to line 21 and gas valve 22. Relay 36 closes when the current I is greater than a threshold current level $I_1$.

Line 21 is only coupled to power source 12 via line 13 when $I_1<I<I_2$. When the current level is too low ($I<I_1$; temperature too low) or the current level is too high ($I>I_2$; temperature too high), gas valve 22 will be shut off, thus providing a safety feature to the gas appliance. The minimum current limit $I_1$ protects against an open circuit condition which may have been caused by ignitor burnout, for example. The maximum current limit $I_2$ protects against a short across the ignitor or elsewhere, for example.

Alternatively, relays 32 and 36 can be changed in position without affecting operation of ignition controller 16. Further, the present invention is not limited to the use of solenoid relays. Other current sensitive circuit components such as switches and diodes can be utilized in ignition controller 16 as will be apparent to those of skill in the art given the present description.

According to one embodiment of the invention, the ignition system 10 will provide gas to burner 26 when the current is at a level corresponding to an ignitor temperature of between 800 degrees and 1500 degrees centigrade. Typically, a temperature range of between 1100 and 1400 degrees centigrade is utilized. The actual values for the lower and upper current levels (i.e., $I_1$ and $I_2$) can depend on a number of factors including, but not limited to, the voltage source utilized, the resistance characteristics of the ignitor, and the physical size of the ignitor. Accordingly, the upper and lower current levels can be selected based on these factors, as would be apparent to one of skill in the art given the present description.

Relays 32 and 36 can be conventional solenoid relays, which can be purchased from a variety of commercial vendors such as Newark Electronics Corp., of New Jersey. For example, relays 32 and 36 can be two-way spring loaded contact relays. The relays can be adapted to operate with a variety of power sources, as would be apparent to one of skill in the art. Further, ignition controller 16 can be adapted to control the ignition of additional burners and the opening of additional valves as would be apparent to one of skill in the art given the present description.

Figure 3:
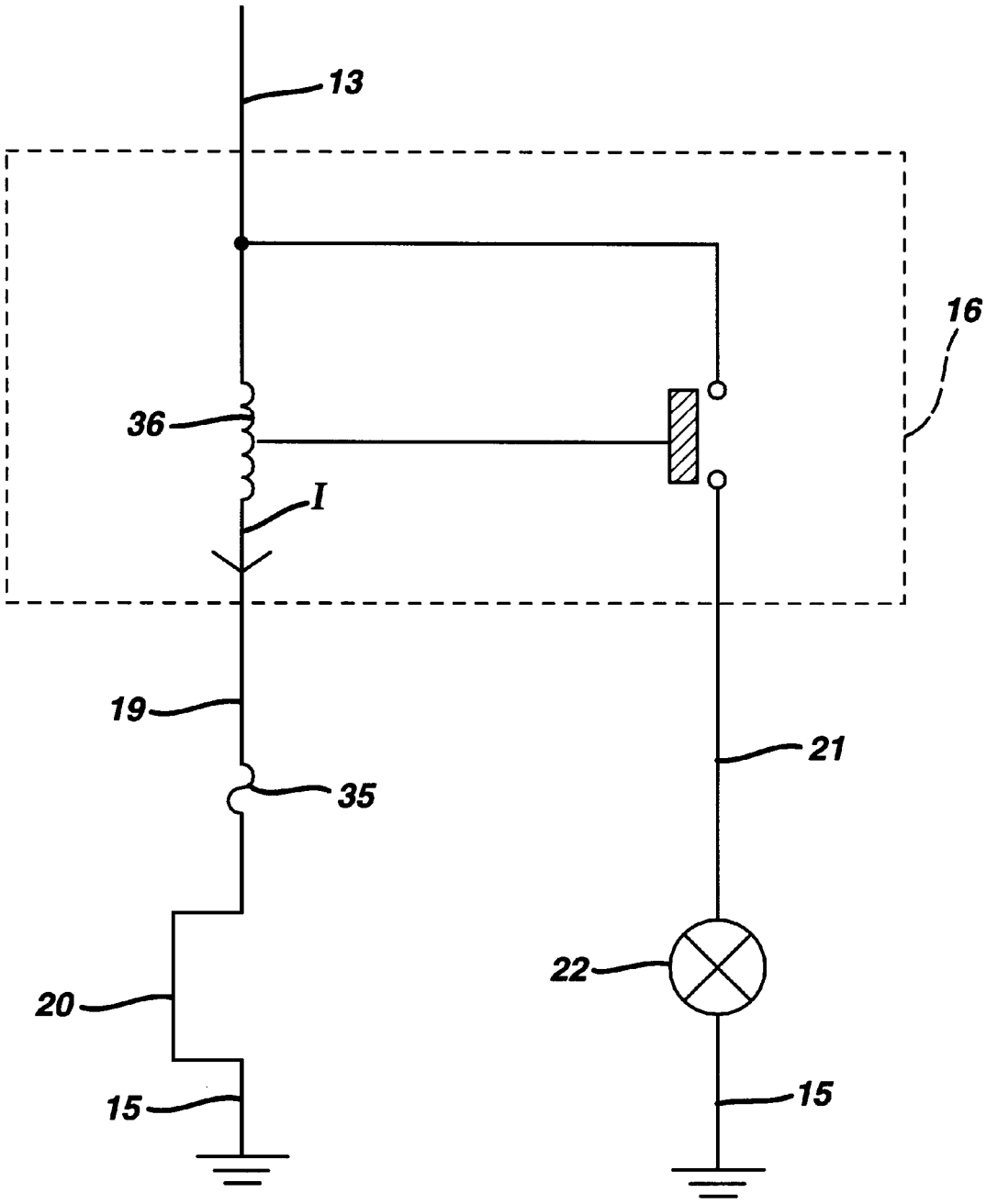
FIG. 3 shows another embodiment of the ignition system.

According to another embodiment of the present invention shown in FIG. 3, relay 32 can be removed from the circuit altogether. Relay 36 is a current actuated relay that is normally in the open position, and closes when the current I is greater than a threshold current level $I_1$. A fuse 35, such as a conventional fuse, can be placed in line 19 proximate to the ignitor 20, such that if the current through line 19 exceeds a upper current limit $I_2$, the fuse 35 is blown, and the current in line 19 goes to zero. When the current in line 19 goes to zero, the relay 36 opens, which deactivates the gas valve 22. Fuse 35 can be a timed fuse, such as a "slow-blow" fuse, available from a variety of commercial electronics vendors. Alternatively, fuse 35 can be designed according to the current characteristics of the ignition system being utilized.

Figure 4:
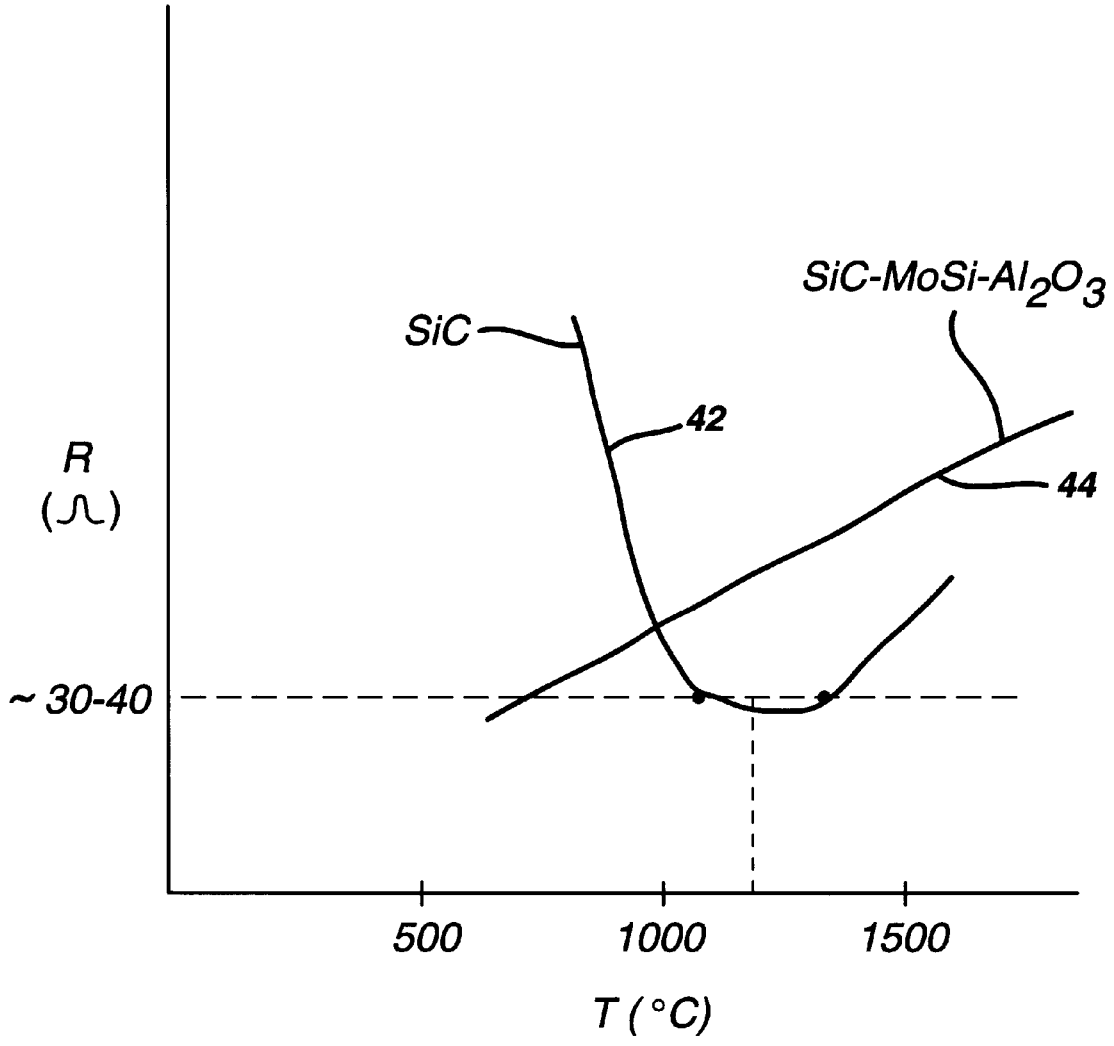
FIG. 4 shows the resistance versus temperature characteristics of silicon carbide and pressure sintered SiC—$MoSi_2$—$Al_2O_3$.

According to one embodiment of the present invention that produces acceptable results, the ignitor 20 comprises a material which has a metallic resistance characteristic in which resistance increases with temperature. As mentioned above, conventional ignitors, such as silicon carbide ignitors, are implemented in conventional ignition systems based on their resistance characteristics. As the temperature of the SiC ignitor increases, its resistance decreases. An example of this relationship is depicted in FIG. 4, wherein the Y axis represents resistance, and the X axis represents temperature. Resistance curve 42 represents an exemplary SiC ignitor used in conventional gas appliances. The resistance curve 42 for the SiC ignitor drops to a resistance of about 30 to 40 ohms (Ω) at temperatures approaching 1200 degrees centigrade. As the temperature continues to increase, the resistance rises to a level greater than 40Ω, and continues upward. This region of the resistance curve has been utilized in some conventional ignition systems as a safety feature, or fail-safe region, in that a gas valve is only actuated when the resistance falls within a certain range. The temperature value of about 1200 degrees is sufficient to ignite natural gas.

The ignition system according to exemplary embodiments of the invention includes an ignitor made from a material having a resistance versus temperature characteristic that typically does not exhibit a fail safe region such as that shown in curve 42. Conventional ignition systems relying on a resistance fail-safe region are thus generally incompatible with ignitor materials having a metallic resistance characteristic.

According to one embodiment of the invention, the ignitor 20 comprises a composite material which may be formed by pressure sintering. Typically, the composite material includes an insulating ceramic, a semiconductive ceramic, and a metallic conductor. The insulating ceramic may comprise, for example, the nitride of a metal, e.g. AlN or $Si_3N_4$, or the oxide of a metal, e.g. $Al_2O_3$. Examples of suitable semiconductive ceramics include silicon carbide and boron carbide. Suitable metallic conductors include molybdenum disilicide and iron alloys, for example. The composite material typically has a metallic resistance characteristic. Examples of suitable pressure sintered composite materials include SiC—$MoSi_2$—AlN and SiC—$MoSi_2$—$Al_2O_3$ composites, which are commercially available.

According to exemplary embodiments of the invention, SiC—$MoSi_2$—AlN or SiC—$MoSi_2$—$Al_2O_3$ is utilized as the composite ignitor material. As shown in FIG. 4, SiC—$MoSi_2$—$Al_2O_3$ has a "metallic" resistance versus temperature characteristic in which the resistance of the material continues to increase with temperature, as shown by curve 44. Other suitable ignitor compositions typically exhibit a metallic resistance versus temperature characteristic which may have a greater or lesser slope than that of curve 44.

The composite ignitor can be made according to pressure sintering techniques that are well known to those skilled in the art. For example, the starting materials can be mixed in powder form to form large blocks of the composite ignitor material. The block is then sintered and hot-pressed. The block is cut into a conventional ignitor shape. Electrical leads and conductors are metalized onto the ends of the ignitor. Such composite ignitors are commercially available from Norton Ignitor Products, of Milford, N.H., for example.

Figure 5:
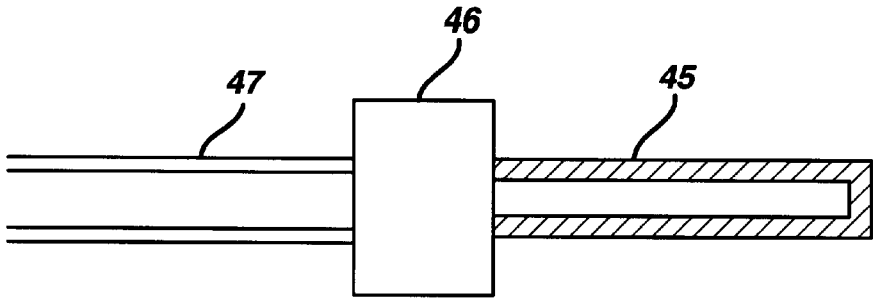
FIG. 5 shows one embodiment of an ignitor.
Figure 6:
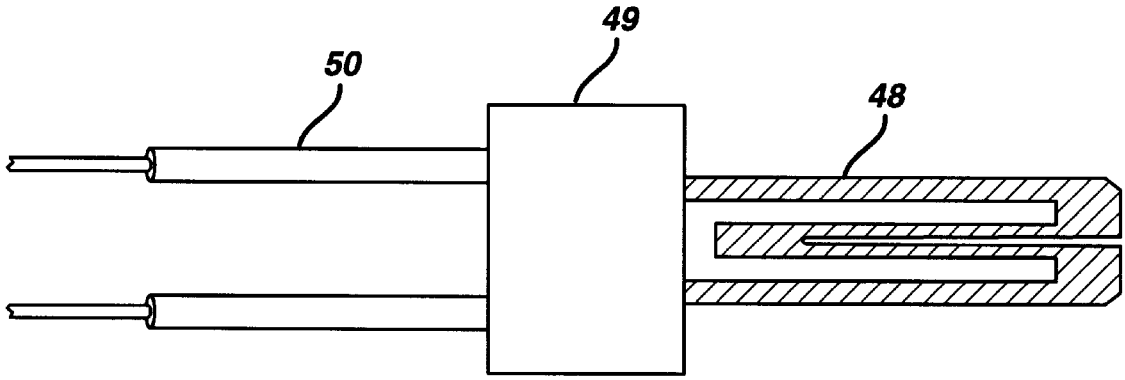
FIG. 6 shows another embodiment of an ignitor.

The composite materials can be utilized in conventional ignitor designs such as shown in FIGS. 5 and 6. In FIG. 5, the composite material is constructed into a hair-pin or "U"-shaped ignitor 45. A ceramic (or the like) holder 46 is filled with a high temperature insulating material and holds ignitor 45 in place in the gas stream. Leads 47 provide current to ignitor 45 in order to heat ignitor 45 to a desired temperature. Similarly, FIG. 6 shows an alternative shape ignitor 48 that is held by a ceramic (or the like) holder 49 and is heated via leads 50. In addition, a metal shield assembly (not shown) and/or other conventional ignitor accessories can be utilized as would be apparent to one of skill in the art given the present description.

Figure 7:
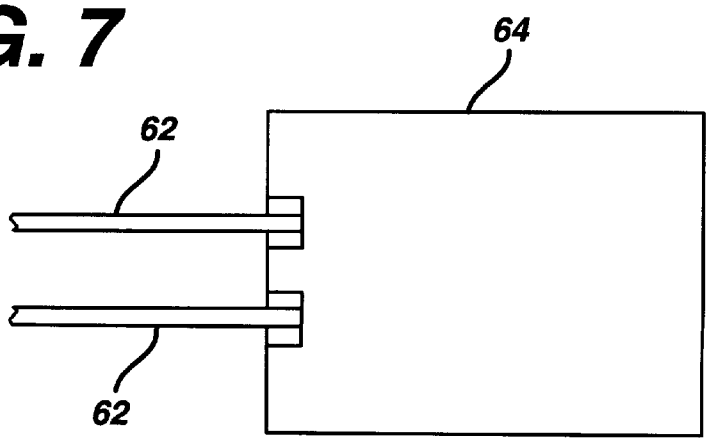
FIG. 7 shows another embodiment of an ignitor.

The ignitor, according to another embodiment of the invention, may comprise a resistive material disposed between two ceramic members. FIG. 7 shows an example of a suitable ignitor of this type. In FIG. 7, the leads 62 are electrically connected to the resistive material disposed between two ceramic plates 64. The resistive material receives the current and generates heat, and may comprise, for example, molybdenum, tungsten, or a compound of tungsten such as tungsten carbide or tungsten silicide. The ceramic material, which may comprise silicon nitride for example, provides high temperature strength and thermal shock resistance to make the structure robust and isolates the resistive material from the ambient gases. The resistance characteristic of this type of heater is typically a metallic resistance characteristic in which resistance increases roughly linearly with temperature. Such heaters are commercially available from Kyocera Corporation, for example.

Figure 8:
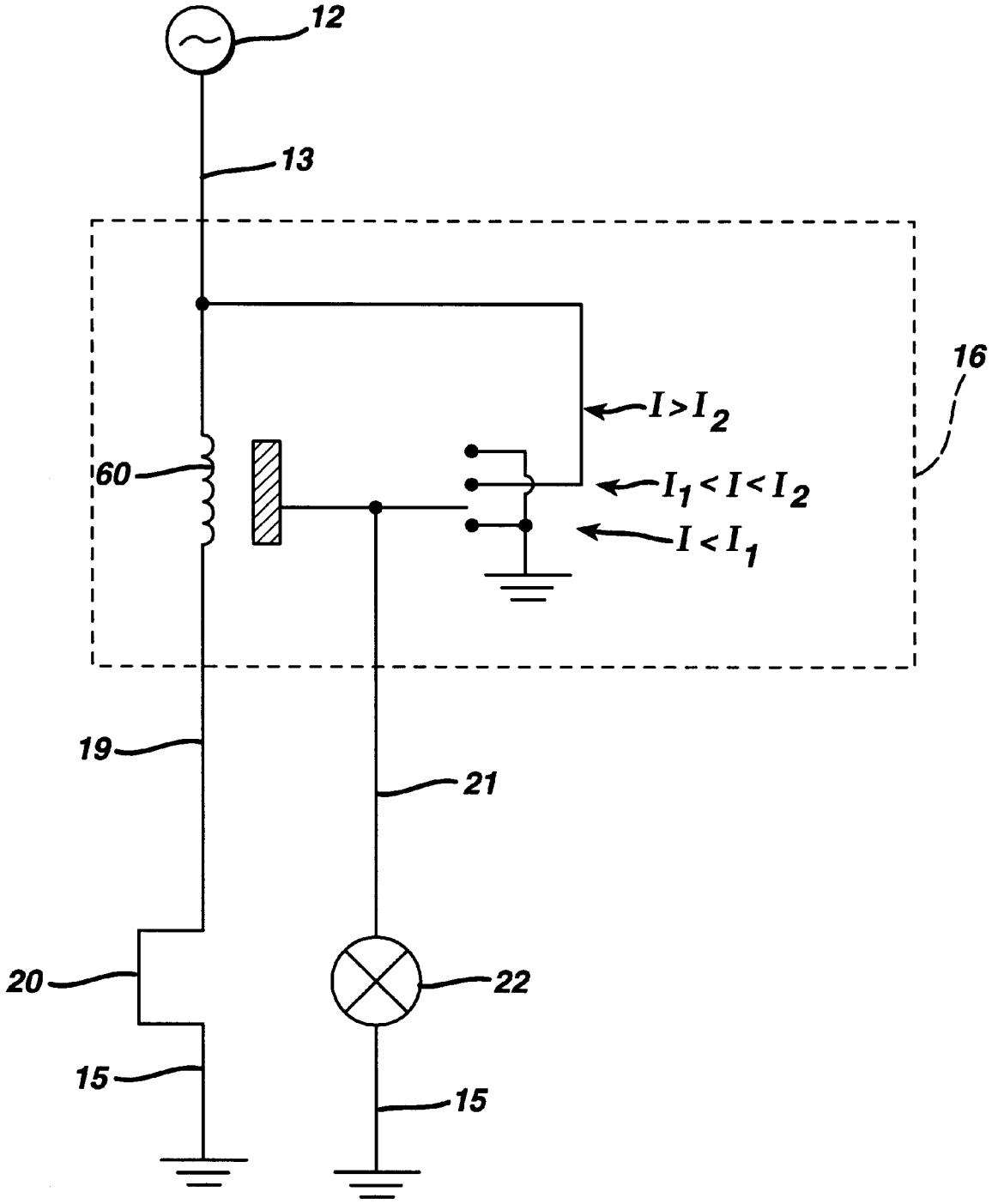
FIG. 8 shows an alternative embodiment of the ignition system.

In another embodiment of the present invention shown in FIG. 8, ignition controller 16 includes a three-way (multi-position) solenoid relay 60. Multi-position relay 60 has three possible positions. When the current (I) across relay 60 is less than a lower threshold current ($I_1$), relay 60 is in the open position (line 13 is not connected to gas valve 22). When the current (I) across relay 60 is greater than the lower threshold current ($I_1$), but less than an upper limit current ($I_2$), relay 60 is in the closed position (coupling line 13 to gas valve 22). When the current (I) across relay 60 is greater than the upper limit current ($I_2$), relay 60 is in the open position (line 13 is not connected to gas valve 22). This embodiment of ignition controller 16 can produce similar results to those achieved with a two relay circuit, such as the embodiment shown in FIG. 2.

Figure 9:
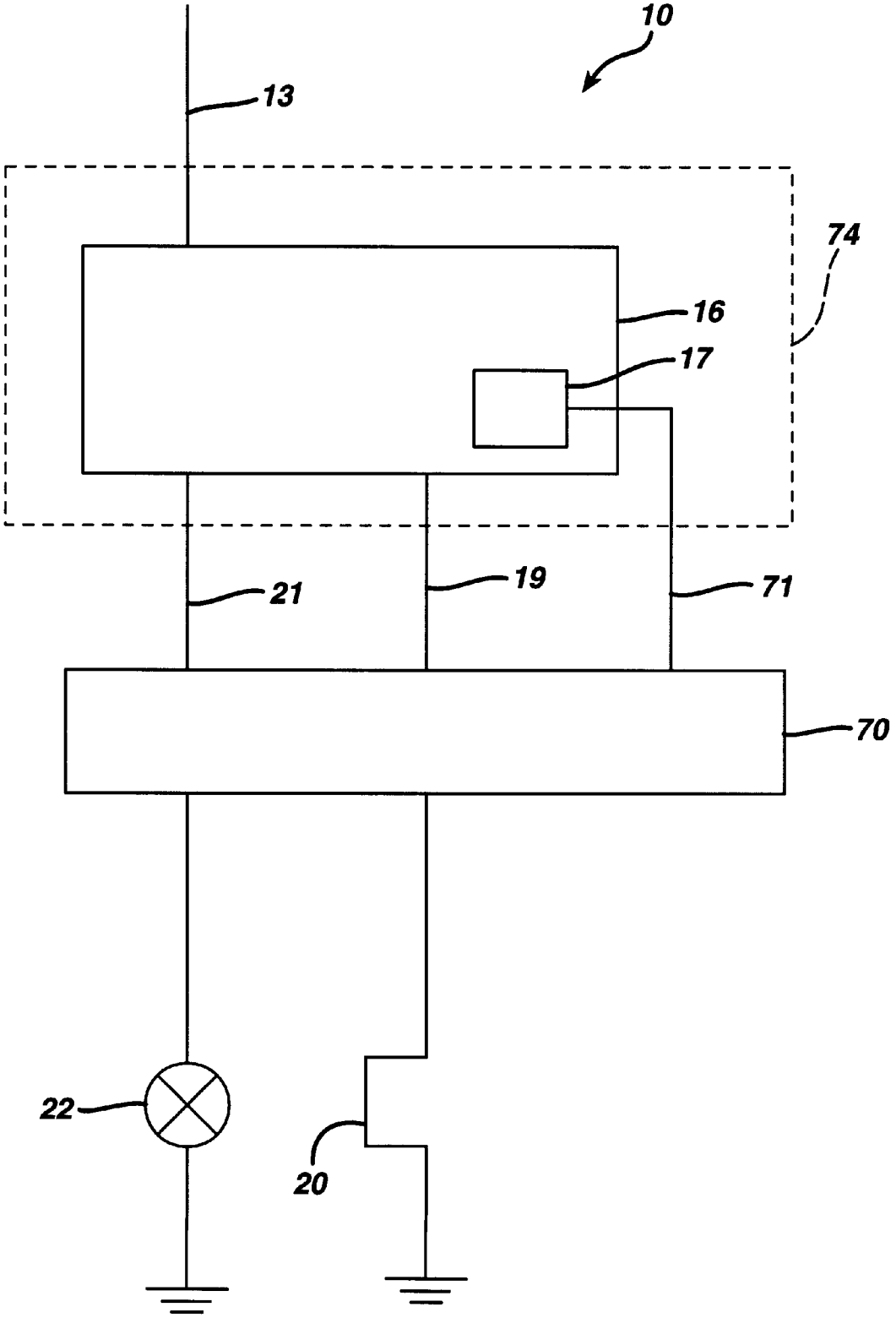
FIG. 9 shows an alternative embodiment of the ignition system.

In another embodiment of the present invention shown in FIG. 9, ignition system 10 further comprises a timing controller 70. Timing controller 70 is coupled to ignition controller 16 via line 71. Timing controller 70 is adapted to block the flow of current to valve 22 and/or ignitor 20 in order to synchronize the ignitor and the valve operation. In this embodiment ignition controller 16 can be included as part of an electronic range controller 74. Electronic range controllers are commonly used for controlling the operation of gas appliances and are well known in the art.

In the embodiment shown in FIG. 9, ignition controller 16 can further comprise a timing device 17, such as a microprocessor, that is programmed to synchronize the opening of valve 22 corresponding to any time lag that may be present in ignitor 20 reaching a predetermined ignition temperature. For example, depending on the specific ignitor material used in ignitor 20, a one to two second delay or a five to ten second delay may occur between the current (I) reaching a lower threshold current value ($I_1$) and when the ignitor actually reaches a suitable ignition temperature. After this delay, timing device 17 sends a control signal to timing controller 70 via line 71. In this embodiment, timing controller 70 can comprise a switch (not shown) that is activated when timing device 17 sends the control signal to timing controller 70. When the switch is activated, line 21 is coupled to valve 22 and valve 22 is actuated, releasing a flow of gas past ignitor 20, which has reached a suitable ignition temperature.

Figure 10:
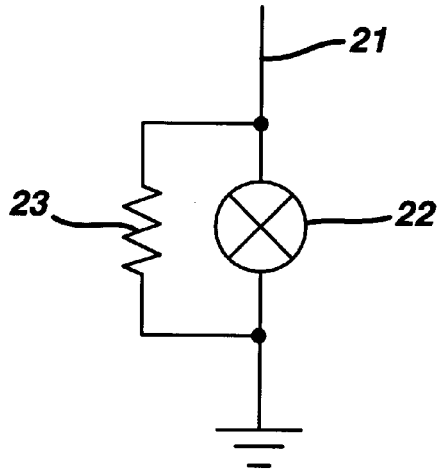
FIG. 10 shows an alternative embodiment of the ignition system.

In yet another embodiment of the present invention shown in FIG. 10, ignition system 10 includes a resistor 23, that is connected in parallel with valve 22 along line 21. Resistor 23 can be of a high resistance (e.g., about 1 meg-ohm (MΩ)). Resistor 23 acts to smooth current surges to valve 22.

Figure 11:
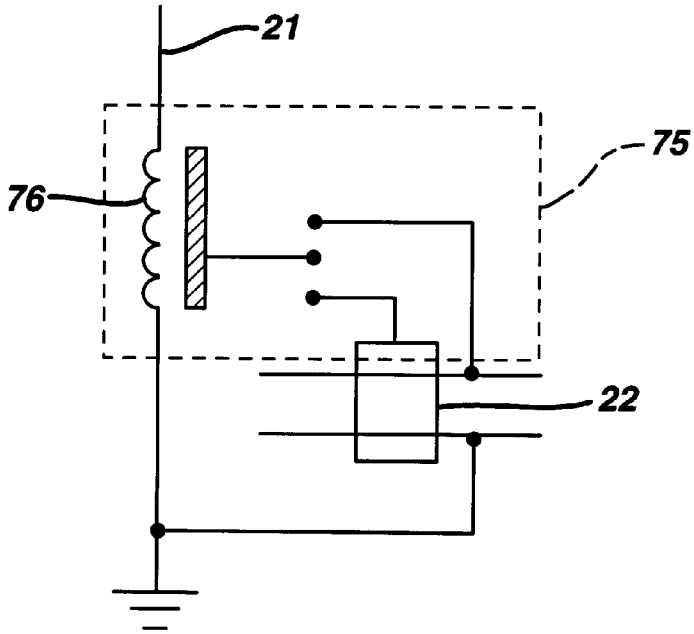
FIG. 11 shows an alternative embodiment of the ignition system.

In another embodiment of the present invention shown in FIG. 11, valve 22 further comprises a valve actuation circuit 75 that includes a relay 76. For example, in this embodiment, ignition controller 16 includes a first relay, such as relay 32 shown in FIG. 2, which is normally closed and opens when the current value I is greater than an upper threshold current $I_2$. Relay 76 is normally open and closes when the current I is greater than a lower threshold current level $I_1$. Thus, valve 22 is only opened when $I_1<I<I_2$. A conventional valve with an actuation circuit can be modified to incorporate relay 76 as would be apparent to one of skill in the art given the present description.

The present invention is particularly useful in a wide range of gas appliances and heating equipment, including gas ovens, furnaces, boilers, and water heaters.

The foregoing description of exemplary embodiments of the invention has been presented for purposes of illustration and description. It is not intended to be exhaustive or to limit the invention to the precise forms disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An ignition system for a gas appliance, comprising:

an ignition controller coupled to a power source;

an ignitor coupled to said ignition controller, the ignitor receiving a current from the ignition controller; and a valve, coupled to said ignition controller, wherein the ignition controller comprises means for activating the valve when said current received by the ignitor is greater than a first current value and less than a second current value.

2. The ignition system of claim 1, further comprising:

a burner coupled to said valve to receive a flow of gas, said ignitor located adjacent to said burner.

3. The ignition system of claim 1, wherein said ignitor comprises a material having a resistance that increases as the temperature of said material increases.

4. The ignition system of claim 1, wherein said ignitor comprises an insulating ceramic, a semiconductive ceramic, and a metallic conductor.

5. The ignition system of claim 1, wherein said ignitor is selected from the group consisting of SiC—$MoSi_2$—AlN and SiC—$MoSi_2$—$Al_2O_3$.

6. The ignition system of claim 1, wherein said ignitor comprises SiC—$MoSi_2$—AlN.

7. The ignition system of claim 1, wherein said means for activating the valve comprises:

a first relay that closes when said current is greater than the first current value ($I_1$); and a second relay that opens when said current is greater than the second current value ($I_2$), wherein $I_2$ is greater than $I_1$, wherein said valve releases a flow of gas when said current is between $I_1$ and $I_2$.

8. The ignition system of claim 1, wherein said means for activating the valve comprises:

a multi-position relay that activates the valve when said current is greater than the first current value ($I_1$) and less than the second current value ($I_2$), wherein said valve releases a flow of gas when said current is between $I_1$ and $I_2$.

9. The ignition system of claim 1, further comprising:

a valve actuation circuit coupled to said ignition controller and said valve, said valve actuation circuit comprising a relay.

10. The ignition system of claim 1, further comprising:

a timing controller coupled to said ignition controller to synchronize the ignitor reaching a predetermined temperature and the opening of said valve.

11. The ignition system of claim 1, wherein said ignitor comprises a pressure-sintered composite material.

12. The ignition system of claim 1, wherein the ignitor comprises a resistive material disposed between two ceramic members.

13. A gas oven, comprising:

an ignition controller coupled to a power source;

an ignitor coupled to said ignition controller, the ignitor receiving a current from the ignition controller;

a valve, coupled to said ignition controller, wherein the ignition controller comprises means for activating the valve when said current received by the ignitor is greater than a first current value and less than a second current value; and a burner coupled to said valve to receive a flow of gas.

14. The oven of claim 13, wherein the ignitor comprises a pressure-sintered composite material.

15. The oven of claim 13, wherein the ignitor comprises a resistive material disposed between two ceramic members.

16. The oven of claim 13, wherein said means for activating the valve comprises:

a first relay that closes when said current is greater than the first current value ($I_1$); and a second relay that opens when said current is greater than the second current value ($I_2$), wherein $I_2$ is greater than $I_1$, wherein said valve releases a flow of gas when said current is between $I_1$ and $I_2$.

17. The oven of claim 13, wherein said means for activating the valve comprises:

a multi-position relay that activates said valve when said current is greater than the first current value ($I_1$) and less than the second current value ($I_2$), wherein said valve releases a flow of gas when said current is between $I_1$ and $I_2$.

18. The oven of claim 13, wherein said ignitor comprises a material selected from the group consisting of SiC—$MoSi_2$—AlN and SiC—$MoSi_2$—$Al_2O_3$.

19. A method for controlling the ignition of a burner with an ignitor, the ignitor having a resistance characteristic in which resistance increases with temperature, the method comprising:

providing a current (I) to the ignitor; and opening a valve that releases a flow of gas to the burner when the current (I) is greater than a first current value ($I_1$) and less than a second current value ($I_2$), wherein $I_1$ is less than $I_2$, wherein the ignitor ignites gas flowing from the burner when $I_1<I<I_2$.

20. The method of claim 19, wherein the ignitor comprises a pressure-sintered composite material.

21. The method of claim 19, wherein the ignitor comprises a resistive material disposed between two ceramic members.

22. The method of claim 19, further comprising:

synchronizing the opening of the valve with the ignitor reaching a predetermined temperature.

23. The method of claim 19, wherein the ignitor is within a predetermined temperature range when $I_1<I<I_2$.

24. The ignition system of claim 1, wherein the means for activating the valve activates the valve based on the magnitude of the current through the ignitor.

25. The oven of claim 13, wherein the means for activating the valve activates the valve based on the magnitude of the current through the ignitor.

* * * * *